US012796806B2

(12) United States Patent
Sun

(10) Patent No.: US 12,796,806 B2
(45) Date of Patent: Nov. 17, 2026

(54) MODULAR FOLDING TABLE WITH DETACHABLE FOLDING STOOL

(71) Applicant: Ningbo Libijia Intelligent Technology Co., Ltd., Ningbo (CN)

(72) Inventor: Liang Sun, Ningbo (CN)

(73) Assignee: NINGBO LIBIJIA INTELLIGENT TECHNOLOGY CO., LTD, Ningbo (CN)

( * ) Notice: Subject to any disclaimer, the term of this patent is extended or adjusted under 35 U.S.C. 154(b) by 49 days.

(21) Appl. No.: 19/208,550

(22) Filed: May 14, 2025

(65) Prior Publication Data

US 2026/0026612 A1 Jan. 29, 2026

Related U.S. Application Data

(63) Continuation-in-part of application No. PCT/CN2025/072715, filed on Jan. 16, 2025.

(30) Foreign Application Priority Data

Jul. 29, 2024 (CN) ..... 202421805597.2

(51) Int. Cl.

| | |
|---|---|
| ***A47B 3/08*** | (2006.01) |
| ***A47B 13/16*** | (2006.01) |
| ***A47C 4/04*** | (2006.01) |
| ***A47C 9/10*** | (2006.01) |

(52) U.S. Cl.

CPC ..... *A47B 3/08* (2013.01); *A47B 13/16* (2013.01); *A47C 4/04* (2013.01); *A47C 9/10* (2013.01); *A47B 2003/0824* (2013.01)

(58) Field of Classification Search

CPC .. A47B 3/08; A47B 3/063; A47B 3/06; A47B 2003/0821; A47B 2003/0824; A47B 13/16; A47C 4/04; A47C 9/10

See application file for complete search history.

(56) References Cited

U.S. PATENT DOCUMENTS

| | | | | |
|---|---|---|---|---|
| 2,805,707 A * | 9/1957 | Schoeppner | ..... | A47B 3/063 108/38 |
| 2,827,352 A * | 3/1958 | Boyajian | ..... | A47B 3/063 D21/900 |
| 8,225,726 B1 * | 7/2012 | Fineberg | ..... | A47B 3/06 108/115 |

(Continued)

FOREIGN PATENT DOCUMENTS

| | | | | |
|---|---|---|---|---|
| CN | 111513493 A * | 8/2020 | ..... | A47B 3/002 |

*Primary Examiner* — Daniel J Rohrhoff

(74) *Attorney, Agent, or Firm* — MATTHIAS SCHOLL P.C.; Matthias Scholl

(57) ABSTRACT

A modular folding table including: a table plate including a bottom surface; a plurality of folding support legs disposed on the bottom surface of the table plate; a plurality of locking tabs; a base plate; and a folding stool. The table plate further includes a central through hole which is circular. The plurality of locking tabs is spaced apart along an inner wall of the central through hole and project toward a center of the central through hole. The base plate is disposed on the plurality of locking tabs in the central through hole. The base plate includes an underside, and a latch mechanism is disposed on the underside. The folding stool is hung and secured to the base plate through the latch mechanism.

10 Claims, 10 Drawing Sheets

(56) References Cited

U.S. PATENT DOCUMENTS

| | | | | |
|---|---|---|---|---|
| 2011/0012392 | A1* | 1/2011 | Herschler | A47B 13/021<br>297/139 |
| 2024/0057758 | A1* | 2/2024 | Sun | A47B 13/02 |
| 2024/0335017 | A1* | 10/2024 | Craig | A47B 3/10 |

* cited by examiner

MODULAR FOLDING TABLE WITH DETACHABLE FOLDING STOOL

CROSS-REFERENCE TO RELATED APPLICATIONS

This application is a continuation-in-part of International Patent Application No. PCT/CN2025/072715 with an international filing date of Jan. 16, 2025, designating the United States, further claims foreign priority benefits to Chinese Patent Application No. 202421805597.2 filed Jul. 29, 2024. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to a folding table, and more particularly to a modular folding table with a detachable folding stool.

Folding tables are common fixtures in daily life, widely used in restaurants, cafes, and households with limited space. A conventional folding table typically includes a main tabletop and folding panels. The main tabletop is usually square-shaped, with folding panels attached to each side via hinge mechanisms. When needed, the folding panels can be flipped upward from below to form an expanded circular table surface.

The above-mentioned folding tables have the following shortcomings:

Due to their large size, they can only be used in fixed locations and are not convenient to carry or transport.

When in use, they require multiple chairs or stools, which may either be separate from the folding table or structurally integrated with it.

SUMMARY

To solve the previously mentioned problems, one objective of the disclosure is to provide a modular folding table comprising: a table plate comprising a bottom surface; a plurality of folding support legs disposed on the bottom surface of the table plate; a plurality of locking tabs; a base plate; and a folding stool. The table plate further comprises a central through hole which is circular; the plurality of locking tabs are spaced apart along an inner wall of the central through hole and project toward a center of the central through hole; the base plate is disposed on the plurality of locking tabs in the central through hole; the base plate comprises an underside, and a latch mechanism is disposed on the underside; and the folding stool is hung and secured to the base plate through the latch mechanism.

In a class of this embodiment, the latch mechanism comprises a latch actuator mounted on a top surface of the base plate and a movable locking plate disposed on the underside; an upper surface of the folding stool comprises a locking slot configured to receive and secure the locking plate; and the locking plate is engaged with the latch actuator for synchronized operation.

In a class of this embodiment, both the locking slot and the locking plate are two in number; a first slot of the two locking slots has a crescent-shape and a second slot of the two locking slots has a circular shape; the underside of the base plate comprises a crescent-shaped positioning rim that aligns with and inserts into the first slot and a circular positioning sleeve that aligns with and inserts into the second slot; two locking plates are a first locking plate disposed in the positioning rim and a second locking plate disposed in the positioning sleeve.

In a class of this embodiment, the first locking plate and the second locking plate are movable toward or away from each other along slide rails mounted on the underside of the base plate; locking steps are respectively disposed in the first slot and the second slot, and the first locking plate and the second locking plate are clamped in the first slot and the second slot, respectively, through the locking steps.

In a class of this embodiment, the latch actuator comprises a first lock and a second lock, both mounted on the top surface of the base plate; the first lock and the second lock are vertically aligned with the first locking plate and the second locking plate, respectively; and each of the first lock and the second lock comprises an engagement lever and a fastening lever.

In a class of this embodiment, a top center of the base plate comprises a threaded hole and a decorative rod securely screwed in the threaded hole; the decorative rod is in a linear, curved, or spiral configuration and extends upward; and a top end of the decorative rob comprises a hook for hanging lighting fixtures, decorative ornaments, or wind chimes.

In a class of this embodiment, a side edge of the table plate comprises a handle hole that facilitates gripping.

In a class of this embodiment, the plurality of folding support legs are at least three in number and are spaced-apart; each of the folding support legs comprises a leg mount installed on an underside of the table plate, a hinge pin that pivotally connects upper ends of the folding support legs to the leg mount, an upper leg, and a lower leg; the lower leg is telescopically inserted into the upper leg; a spring-loaded ball detent is disposed between a lower end of the upper leg and an upper end of the lower leg to lock the lower leg in place when the lower leg fully extends to a limit position thereof.

In a class of this embodiment, the leg mount is a vertically elongated rectangular sleeve with an open side wall and an open bottom face; the upper leg is foldable toward the table plate through the open side wall of the leg mount, or is bendable and pulled out from the underside of the table plate.

In a class of this embodiment, the open bottom face of the leg mount comprises a clamping plate configured to prevent the folding support legs from accidentally bending and extending when the folding support legs are retracted to a folded position.

The modular folding table of the disclosure comprises a small table and a stool that can be folded separately and used independently or together. When traveling outdoors, both the table and the stool can be folded separately and then assembled through snap-fit connection mechanisms to form an aesthetically pleasing, compact, and portable unit. During use, the snap-fit connection mechanisms can be simply disengaged to separately deploy the table and stool. This multifunctional product serves as both a laptop workstation and a leisure stool. By installing the decorative rod on the tabletop and hanging lighting fixtures, decorative ornaments, or wind chimes on the rod's hook, the folding table can be transformed into an outdoor entertainment decoration system, thereby providing multiple configurations that enhance both functional utility and aesthetic appeal in outdoor environments.

Figure 1:
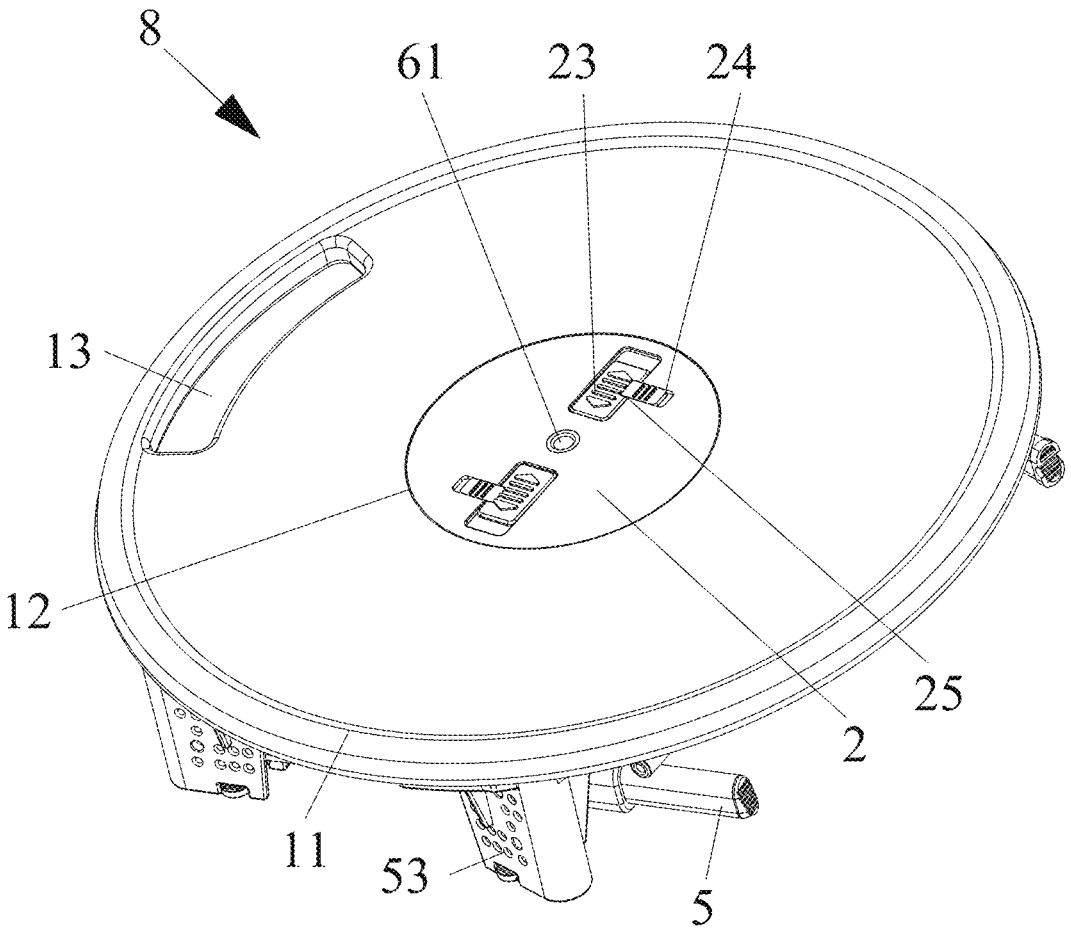
FIG. 1 is a top view of a modular folding table of the disclosure.
Figure 2:
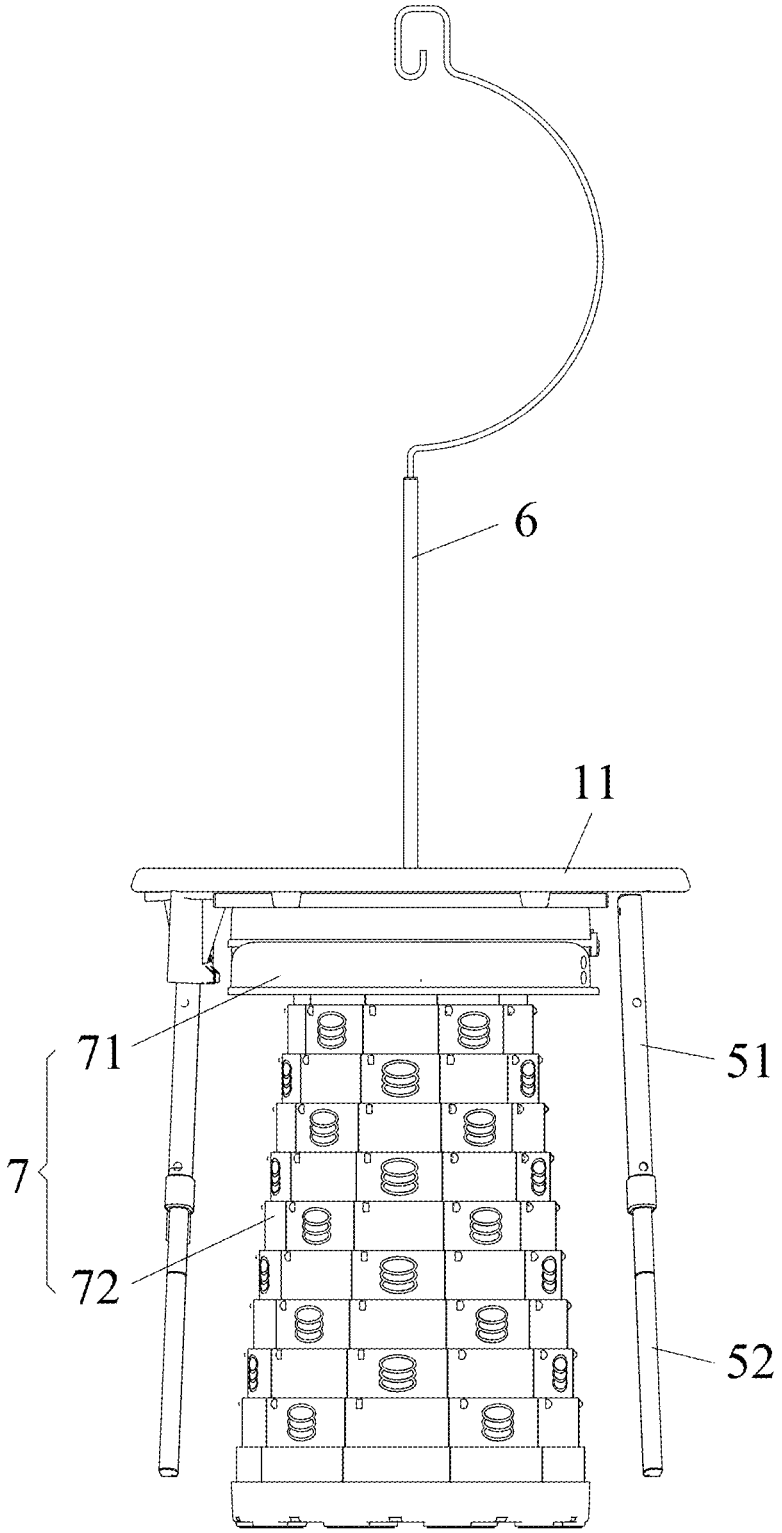
FIG. 2 is a side view of the modular folding table in FIG. 1.
Figure 3:
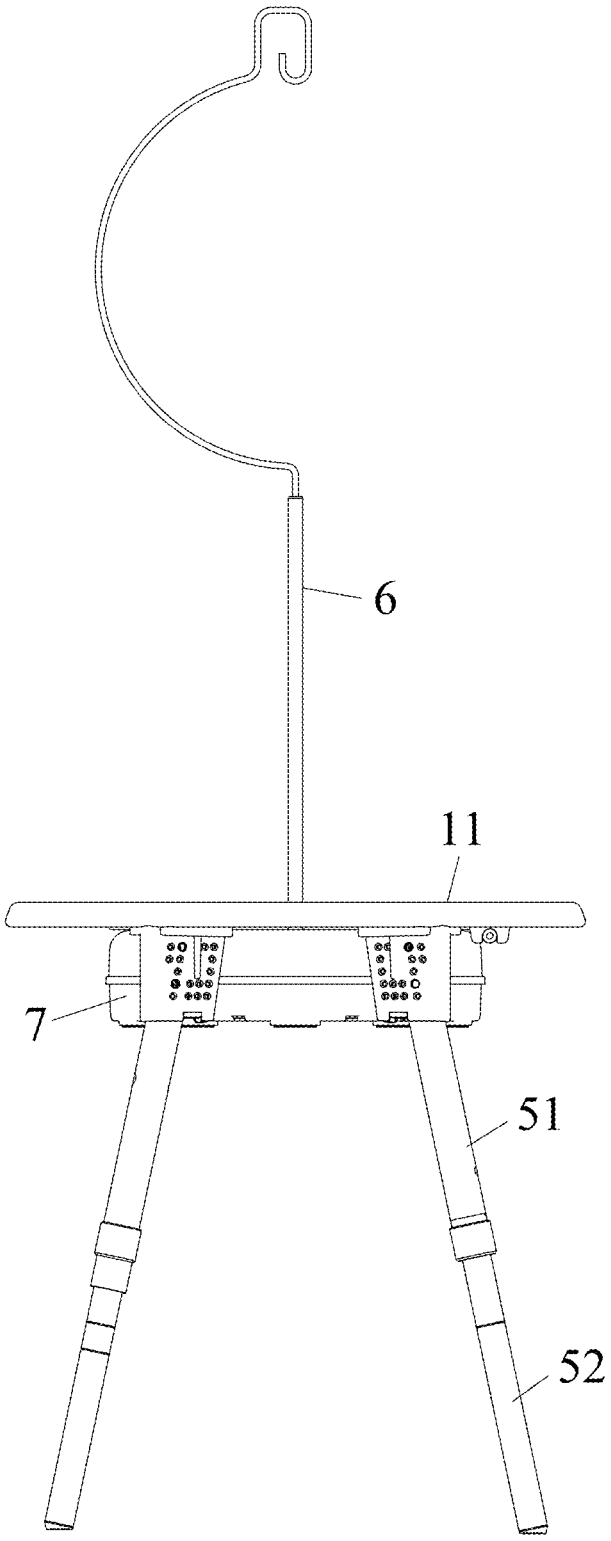
FIG. 3 is a schematic diagram of a folding table in FIG. 2.
Figure 4:
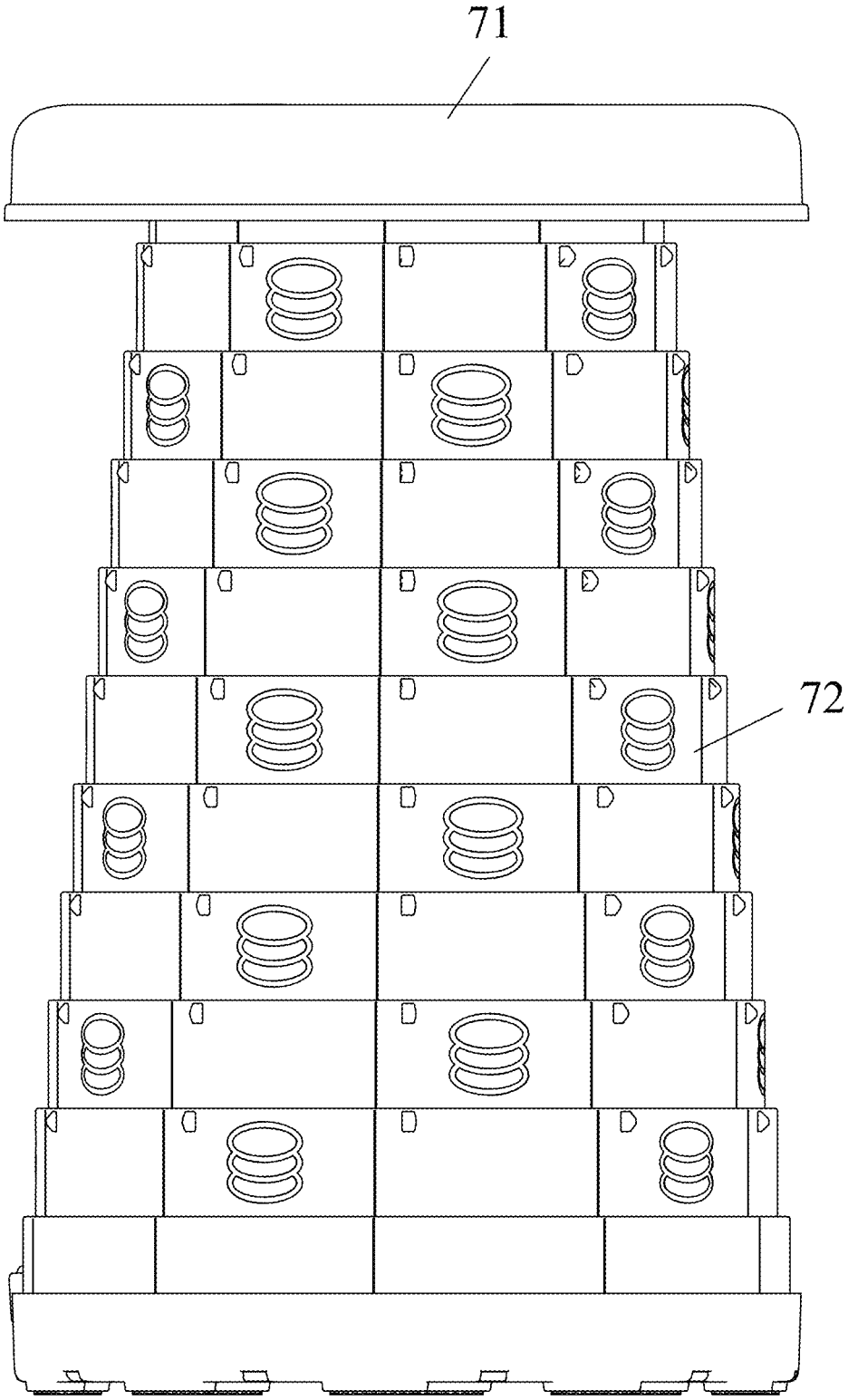
FIG. 4 is a schematic diagram of a folding stool in FIG. 2.

In the drawings, the following reference numbers are used: 1. Folding table; 11. Table plate; 12. Central through hole; 13. Hand hole; 2. Base plate; 21. First lock; 22. Second lock; 23. Engagement lever; 24. Fastening lever; 25. Recess; 26. Cylinder; 261. Fastening plate; 262. Gap; 3. Positioning rim; 31. First locking plate; 4. Positioning sleeve; 41. Second locking plate; 5. Folding support leg; 51. Upper leg; 52. Lower leg; 53. Leg mount; 54. Clamping plate; 6. Decorative rod; 61. Threaded hole; 7. Folding stool; 71. Seat pan; 72. Stool leg; 73. First slot; 74. Second slot; 8. Modular folding table.

DETAILED DESCRIPTION

To further illustrate the disclosure, embodiments detailing a modular folding table with a detachable folding stool are described below. It should be noted that the following embodiments are intended to describe and not to limit the disclosure.

As shown in FIGS. 1-10, the disclosure provides a modular folding table 8 comprising a small table (hereinafter referred to as folding table 1) and a small stool (hereinafter referred to as folding stool 7) that can be folded separately. When not in use, the support legs of the small table are folded onto the bottom surface of the table plate 11 of the small table, and then the folded small stool is assembled with the small table through a quick assembly-disassembly structure disposed between the bottom surface of the table plate 11 and the seat pan 71 of the small stool, to form a compact and portable modular folding table 8.

1. Folding Table 1

As shown in FIG. 3, FIG. 5, FIG. 6, FIG. 7, FIG. 9 and FIG. 10, the folding table comprises a table plate 11 and a plurality of folding support legs 5 which are foldable on the bottom surface of the table plate 11. Preferably, the table plate 11 is circular, and the folding support legs 5 are four in number.

1) Table Plate 11

A central through hole 12 is disposed on the table plate 11 and is circular, and a plurality of locking tabs (not shown in the drawings) are spaced apart along the inner wall of the central through hole 12 and project toward a center of the central through hole. Preferably, four locking tabs are disposed, and between every two adjacent locking tabs, there is a gap 262 having a length greater than the arc length of the locking tabs.

A circular base plate 2 is disposed in the central through hole 12. The base plate 2 comprises an underside and a downwardly extending cylinder 26 is disposed on the underside of the base plate 2. The diameter of the cylinder 26 is smaller than the diameter of the base plate 2. The bottom perimeter of the cylinder 26 comprises evenly spaced fastening plates 261 that extend outward, with the number of the fastening plates matching the quantity of the locking tabs. When the fastening plates 261 align with the gaps 262, the base plate 2 is mounted into the central hole 12. Rotating the base plate 2 clockwise or counterclockwise causes the fastening plates 261 to engage with the locking tabs (after engagement, the screws can be added for further reinforcement). In this way, the base plate 2 is fixed in the center of the table plate 11.

Further, a latch mechanism is disposed on the underside of the base plate 2 and in the inner zone of the cylinder 26, to hang and secure the folding stool 7 to the table plate 11.

The latch mechanism comprises two parts, that is, a latch actuator mounted on the top surface of the base plate 2 and a movable locking plate disposed on the underside of the base plate 2.

The latch actuator comprises a first lock 21 and a second lock 22 disposed on the top surface of the base plate 2. The first lock 21 and the second lock 22 both comprise an engagement lever 23 and a fastening lever 24, and the first lock 21 and the second lock 22 are symmetrically disposed with respect to the center of the base plate 2. The first lock 21 and the second lock 22 have the same structure, and the shapes of the engagement lever 23 and the fastening lever 24 are preferred to be rectangular and are slidable back and forth in a straight line. The long side of the engagement lever 23 comprises a recess 25, and the fastening lever 24 is perpendicular to the engagement lever 23. For locking, the engagement lever 23 slides to the locking position, the fastening lever 24 slides in the direction towards the engagement lever 23, and then the front end of the fastening lever 24 snaps in the recess 25, thus locking the engagement lever 23. When unlocking, the reverse operation can be done.

The locking plate is controlled by the latch actuator. The underside of the base plate 2 comprises a crescent-shaped positioning rim 3 and a circular positioning sleeve 4 corresponding to the first lock 21 and the second lock 22 in position, respectively.

The locking plate are two in number, comprising a first locking plate 31 corresponding to the first lock 21 and a second locking plate 41 corresponding to the second lock 22.

The first locking plate 31 is disposed on the positioning rim 3 and is fixedly connected to the corresponding engagement lever 23; the second locking plate 41 is disposed on the positioning sleeve 4 and is fixedly connected to the corresponding engagement lever 23. The slide rails are disposed in the positioning rim 3 and the positioning sleeve 4 respectively to enable the first locking plate and the second locking plate 41 to move towards or away from each other.

The side edge of the table plate 11 comprises a handle hole 13 that facilitates gripping.

2) Folding Support Legs 5

The plurality of folding support legs 5 are at least three in number and are spaced-apart, preferably, four. Each of the folding support legs 5 comprises a leg mount 53 installed on an underside of the table plate 11 and a hinge pin (not shown in the drawings) that pivotally connects the upper end of the folding support leg 5 to the leg mount 53.

The leg mount 53 is a vertically elongated rectangular sleeve with an open side wall and an open bottom face. The upper end of the leg mount is fixed on the bottom surface of the table plate. The folding support leg 5 comprises an upper leg 51 and a lower leg 52; the lower leg 52 is telescopically inserted into the upper leg 51; a spring-loaded ball detent is disposed between a lower end of the upper leg 51 and an upper end of the lower leg 52 to lock the lower leg 52 in place when the lower leg fully extends to a limit position thereof.

The upper leg is foldable toward the table plate 11 through the open side wall of the leg mount 53, or is bendable and pulled out from the underside of the table plate.

The open bottom face of the leg mount 53 comprises a clamping plate 54 configured to prevent the folding support legs 5 from accidentally bending and extending when the folding support legs are retracted to a folded position.

The four leg mounts 53 corresponding to the four folding support legs 5 of the disclosure are disposed in pairs on opposite sides of the bottom surface of the table plate 11 and centered about the midpoint of the table plate 11, and to allow the two folding support legs 5 on the same side to take up less space when being retracted to the folded position, the hinge pins on the two leg mounts 53 on the same side are provided in two different heights.

2. Decorative Rod 6

Figure 5:
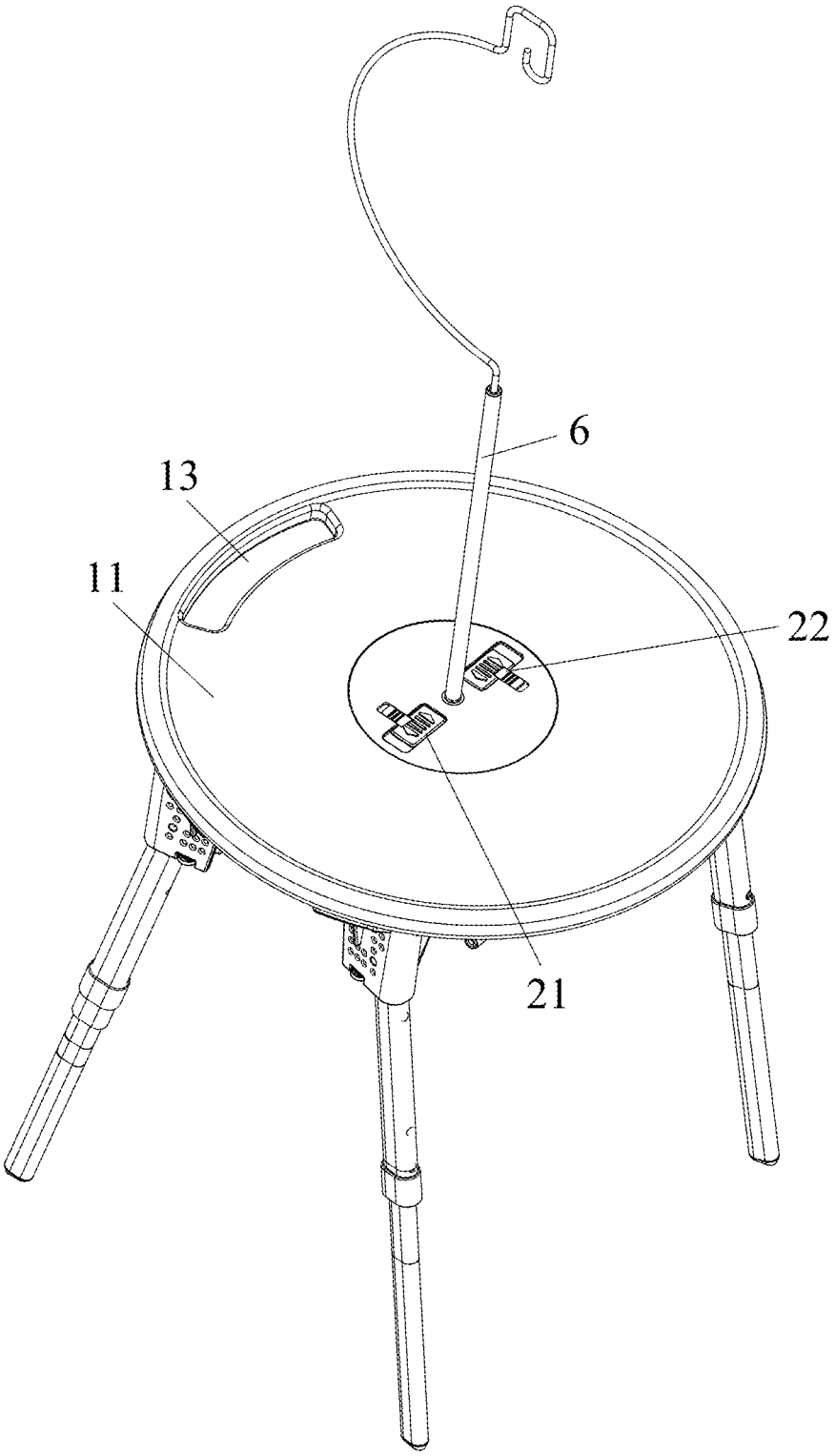
FIG. 5 is an isometric view of the folding table in FIG. 3.
Figure 6:
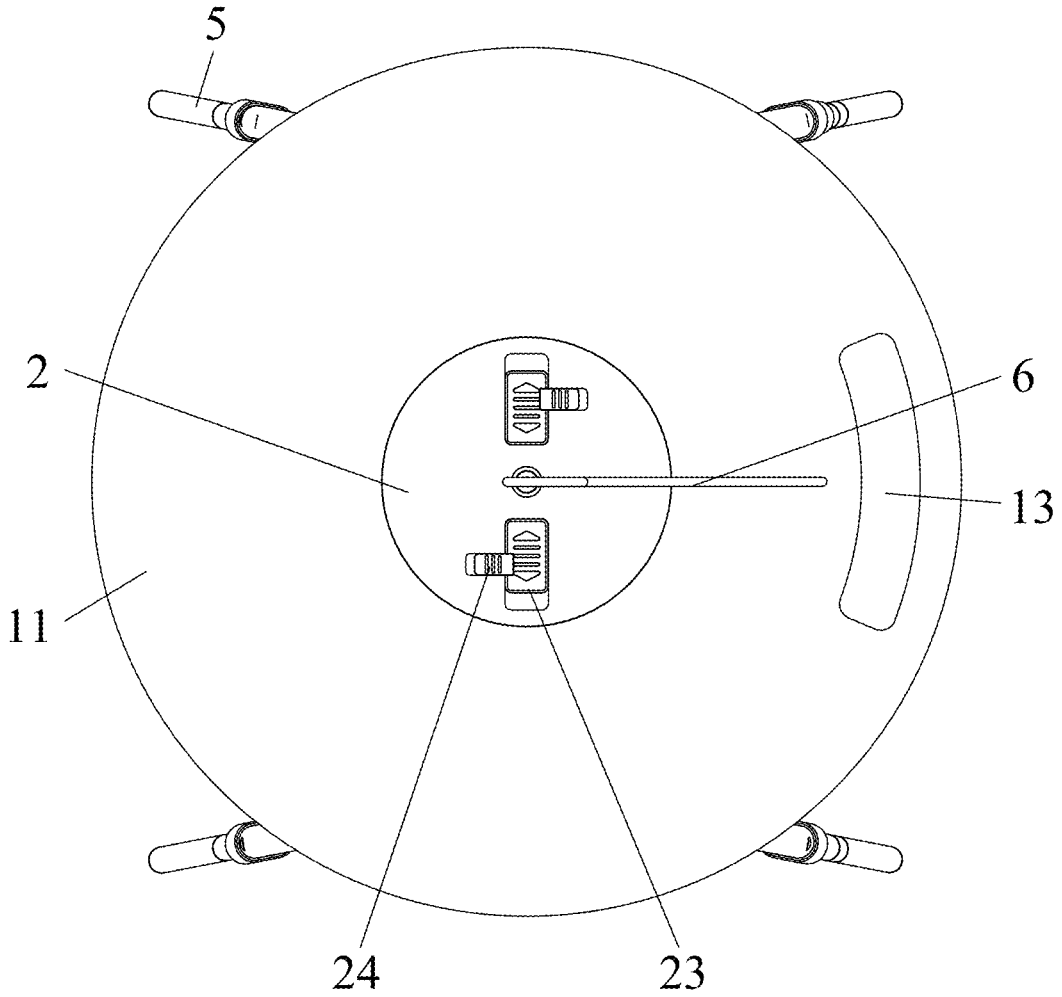
FIG. 6 is a top view of the folding table in FIG. 3.
Figure 7:
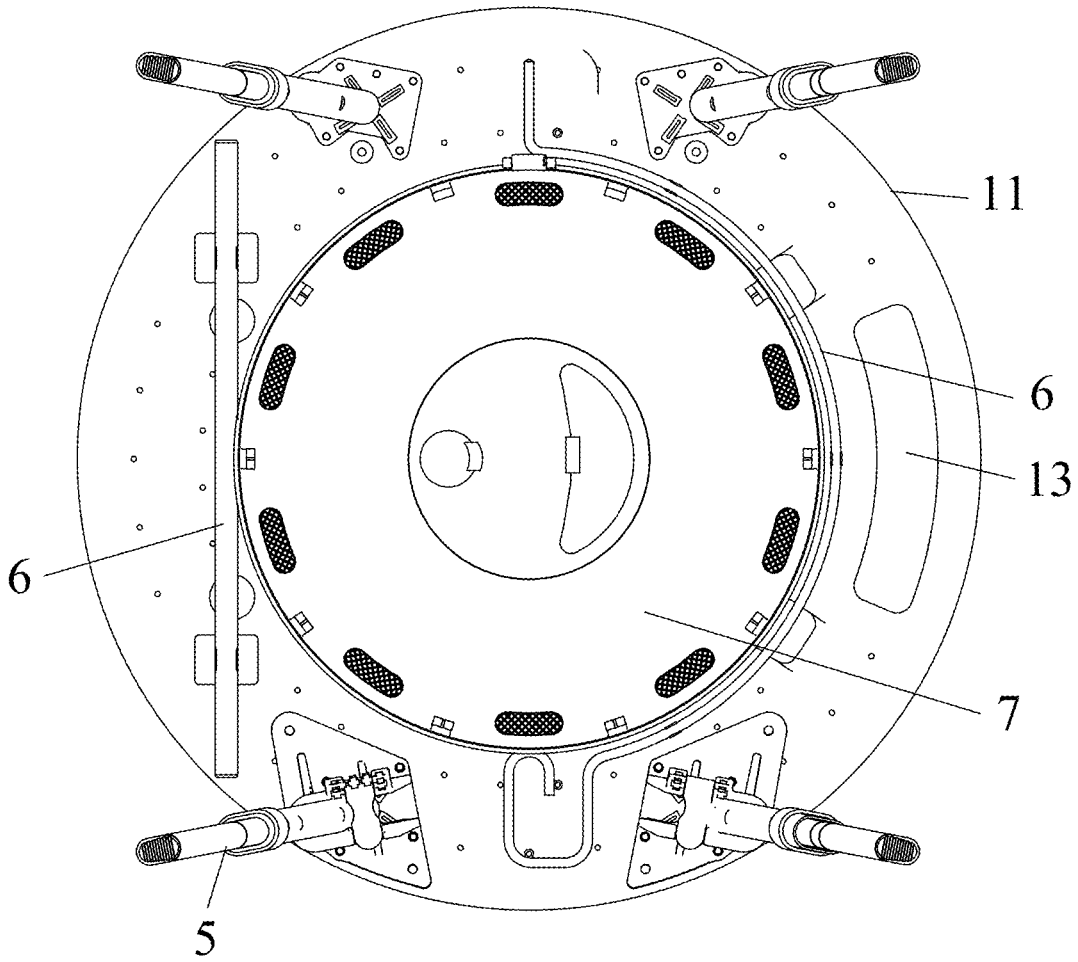
FIG. 7 is a bottom view of the folding table in FIG. 3.
Figure 8:
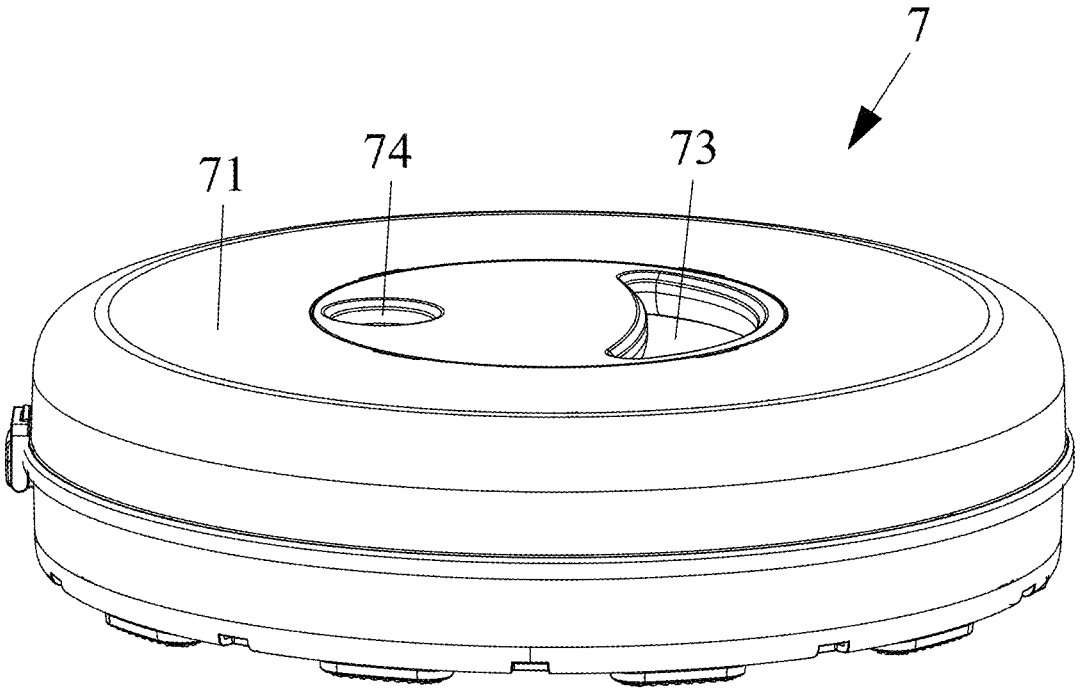
FIG. 8 is a perspective view of a folding stool in a retracted position.
Figure 9:
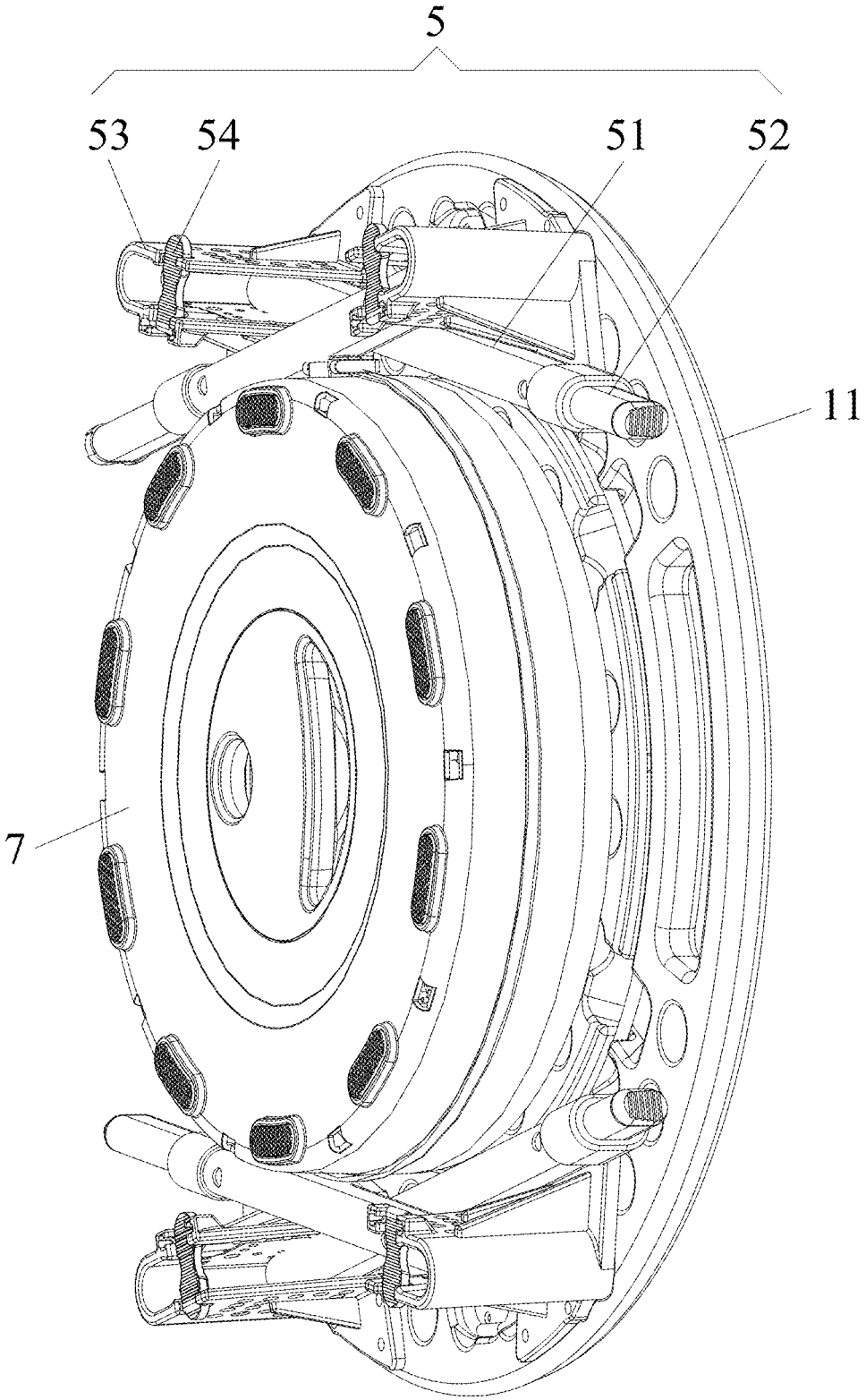
FIG. 9 is a side view of the modular folding table in FIG. 1.
Figure 10:
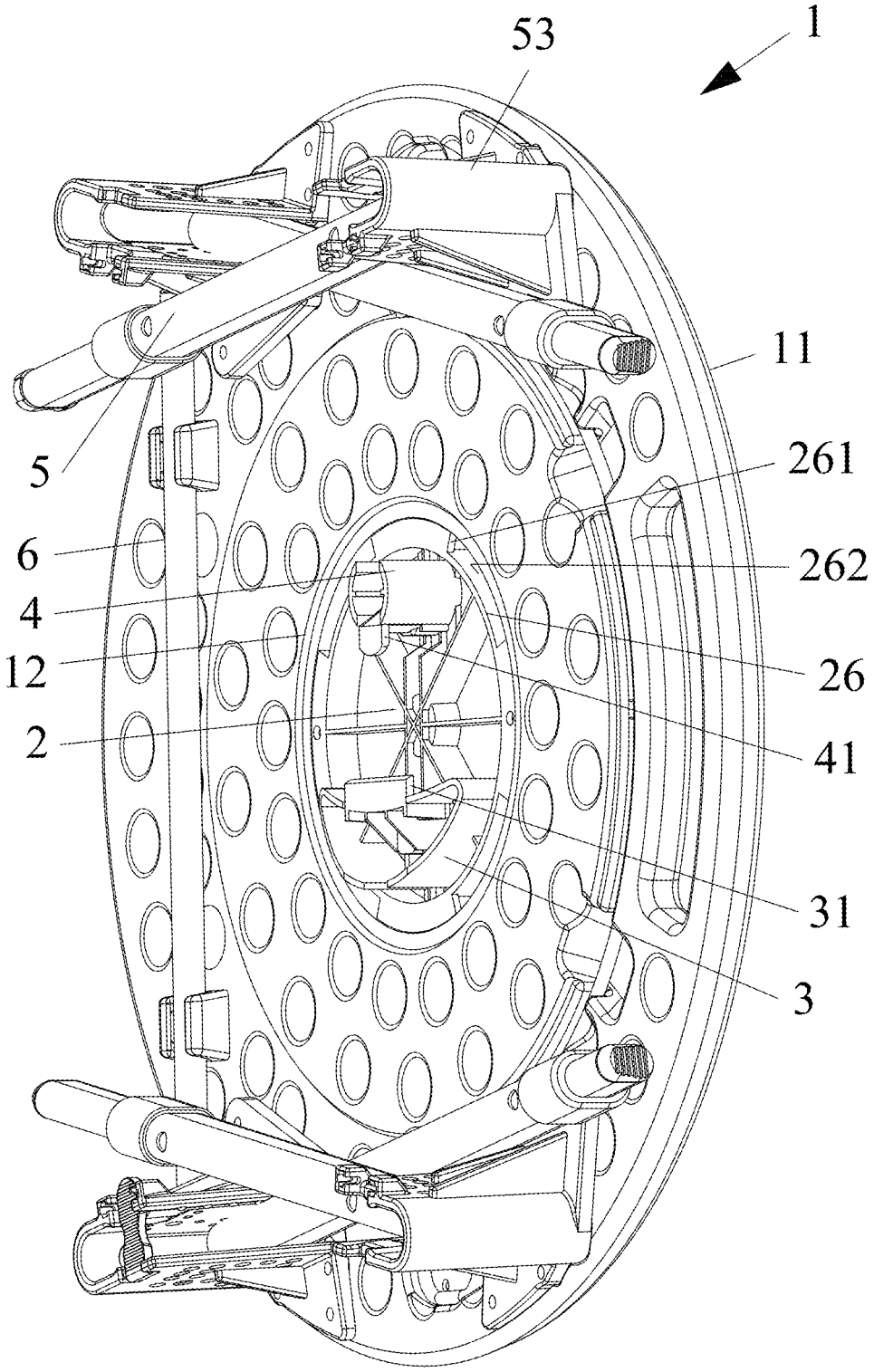
FIG. 10 is a schematic diagram of the modular folding table in FIG. 9 after removing the folding stool.

As shown in FIGS. 5, 7, and 10, as an improvement, the top center of the base plate 2 comprises a threaded hole 61 and a decorative rod 6 securely screwed in the threaded hole; the decorative rod 6 is in a linear, curved, or spiral configuration and extends upward; and the top end of the decorative rob comprises a hook for hanging lighting fixtures, decorative ornaments, or wind chimes.

Preferably, the decorative rod 6 comprises two segments, a straight rod, and a circular arc rod. The lower end of the straight rod is an externally threaded structure, and the upper end of the straight rod is a hollow tube. The lower end of the circular arc rod is inserted into the hollow tube, and the upper end of the circular arc rod comprises a hook.

A mounting position is disposed on the bottom surface of the table plate 11 for fixing the decorative rod 6.

3. Folding Stool 7

As shown in FIGS. 2, 4, 8, and 9, the folding stool 7 comprises a seat pan 71 and a stool leg 72. The seat pan 71 is preferably circular, and the stool leg 72 is a telescopic structure that can extend into a trapezoidal (platform-like) shape when in use and retracts into a cylindrical form for packaging.

Two locking slots are disposed on the upper surface of the seat pan 71 and correspond to the positioning rim 3 and the positioning sleeve 4, respectively.

The first slot 73 of the two locking slots has a crescent-shape and the second slot 74 of the two locking slots has a circular shape; the positioning rim 3 is inserted into the first slot 73 and the positioning sleeve 4 is inserted into the second slot 74.

Correspondingly, a first locking step and a second locking step (both not shown in the drawings) are disposed in the first slot 73 and second slot 74, respectively. When the table plate 11 is combined with the folding stool 7, the first locking plate 31 located on the positioning rim 3 is inserted into the first slot 73, and the second locking plate 41 located on the positioning sleeve 4 is inserted into the second slot 74. Thus, if both the engagement levers 23 of the first lock 21 and the second lock 22 are toggled to the locking position, the first locking plate 31 and the second locking plate 41 are respectively snapped into the first locking step and the second locking step, thereby fixing the folding stool 7 on the folding table 1.

It will be obvious to those skilled in the art that changes and modifications may be made, and therefore, the aim in the appended claims is to cover all such changes and modifications.

What is claimed is:

1. A modular folding table, comprising:

a table plate comprising a bottom surface;

a plurality of folding support legs disposed on the bottom surface of the table plate;

a plurality of locking tabs;

a base plate; and a folding stool;

wherein:

the table plate further comprises a central through hole which is circular;

the plurality of locking tabs are spaced apart along an inner wall of the central through hole and project toward a center of the central through hole;

the base plate is disposed on the plurality of locking tabs in the central through hole;

the base plate comprises an underside, and a latch mechanism is disposed on the underside; and the folding stool is hung and secured to the base plate through the latch mechanism.

2. The modular folding table of claim 1, wherein the latch mechanism comprises a latch actuator mounted on a top surface of the base plate and a movable locking plate disposed on the underside; an upper surface of the folding stool comprises a locking slot configured to receive and secure the locking plate; and the locking plate is engaged with the latch actuator for synchronized operation.

3. The modular folding table of claim 2, wherein both the locking slot and the locking plate are two in number; a first slot of the two locking slots has a crescent-shape and a second slot of the two locking slots has a circular shape; the underside of the base plate comprises a crescent-shaped positioning rim that aligns with and inserts into the first slot and a circular positioning sleeve that aligns with and inserts into the second slot; the two locking plates are a first locking plate disposed in the positioning rim and a second locking plate disposed in the positioning sleeve.

4. The modular folding table of claim 3, wherein the first locking plate and the second locking plate are movable toward or away from each other along slide rails mounted on the underside of the base plate; locking steps are respectively disposed in the first slot and the second slot, and the first locking plate and the second locking plate are clamped in the first slot and the second slot, respectively, through the locking steps.

5. The modular folding table of claim 4, wherein the latch actuator comprises a first lock and a second lock, both mounted on the top surface of the base plate; the first lock and the second lock are vertically aligned with the first locking plate and the second locking plate, respectively; and each of the first lock and the second lock comprises an engagement lever and a fastening lever.

6. The modular folding table of claim 5, wherein a top center of the base plate comprises a threaded hole and a decorative rod securely screwed in the threaded hole; the decorative rod is in a linear, curved, or spiral configuration and extends upward; and a top end of the decorative rod comprises a hook for hanging lighting fixtures, decorative ornaments, or wind chimes.

7. The modular folding table of claim 6, wherein a side edge of the table plate comprises a handle hole that facilitates gripping.

8. The modular folding table of claim 1, wherein the plurality of folding support legs are at least three in number and are spaced-apart; each of the folding support legs comprises a leg mount installed on an underside of the table plate, a hinge pin that pivotally connects upper ends of the folding support legs to the leg mount, an upper leg, and a lower leg; the lower leg is telescopically inserted into the upper leg; a spring-loaded ball detent is disposed between a lower end of the upper leg and an upper end of the lower leg to lock the lower leg in place when the lower leg extends to a limit position thereof.

9. The modular folding table of claim 8, wherein the leg mount is a vertically elongated rectangular sleeve with an open side wall and an open bottom face; the upper leg is foldable toward the table plate through the open side wall of the leg mount, or is bendable and pulled out from the underside of the table plate.

10. The modular folding table of claim 9, wherein the open bottom face of the leg mount comprises a clamping plate configured to prevent the folding support legs from accidentally bending and extending when the folding support legs are retracted to a folded position.

* * * * *